US009920523B2

(12) United States Patent
Bierman

(10) Patent No.: US 9,920,523 B2
(45) Date of Patent: Mar. 20, 2018

(54) PRESSURE-SENSITIVE ROOF STRUCTURE FOR SCREENED ENCLOSURES OF SWIMMING POOLS, SPAS OR PATIOS

(71) Applicant: Timm Bierman, Sussex, WI (US)

(72) Inventor: Timm Bierman, Sussex, WI (US)

( * ) Notice: Subject to any disclaimer, the term of this patent is extended or adjusted under 35 U.S.C. 154(b) by 0 days.

(21) Appl. No.: 15/477,471

(22) Filed: Apr. 3, 2017

(65) Prior Publication Data

US 2017/0298623 A1 Oct. 19, 2017

Related U.S. Application Data

(60) Provisional application No. 62/322,473, filed on Apr. 14, 2016.

(51) Int. Cl.

| | |
|---|---|
| ***E04B 1/346*** | (2006.01) |
| ***E04B 7/16*** | (2006.01) |
| ***E04B 1/344*** | (2006.01) |
| ***E04B 7/02*** | (2006.01) |

(52) U.S. Cl.

CPC ..... *E04B 7/163* (2013.01); *E04B 1/344* (2013.01); *E04B 7/022* (2013.01)

(58) Field of Classification Search

CPC ..... E04B 1/0046; E04B 7/163; E04B 7/16; E04B 1/344; E04B 7/166; E04B 1/3448; E04B 7/12; A01G 9/241; A01G 9/242; A01G 9/14

USPC ..... 52/64, 72, 200, 6, 66, 79.5, 69, 71, 645; 49/127, 128, 125; 4/494; 160/206, 204; 47/17

See application file for complete search history.

(56) References Cited

U.S. PATENT DOCUMENTS

| | | | | |
|---|---|---|---|---|
| 5,461,831 | A | 10/1995 | Michal | |
| 5,655,335 | A * | 8/1997 | Vermeer | A01G 9/14 47/17 |
| 6,138,417 | A | 10/2000 | Woodard et al. | |
| 8,245,446 | B2 * | 8/2012 | Betker | E05D 15/38 49/197 |
| 8,505,246 | B1 | 8/2013 | Cadorath | |
| 9,441,358 | B2 * | 9/2016 | Hartman | E04L 31/3445 |
| 2006/0248807 | A1 * | 11/2006 | Penna, IV | A01G 9/241 52/64 |
| 2009/0014044 | A1 * | 1/2009 | Hartman | E04L 31/3445 135/143 |
| 2013/0192147 | A1 * | 8/2013 | Schaffert | E04L 31/344 52/79.5 |
| 2014/0059925 | A1 * | 3/2014 | Marsh | E04H 1/1205 47/17 |

* cited by examiner

*Primary Examiner* — Chi Q Nguyen
(74) *Attorney, Agent, or Firm* — Ryan Kromholz & Manion, S.C.

(57) ABSTRACT

A pressure-sensitive relief panel for screened enclosures of swimming pools, spas or patios is disclosed. By securing the panels with a pressure release system the structure and panels can remain intact year round. If a weather event occurs either with or without warning the panels will automatically provide relief from loads or forces imposed by the event that could cause damage or even collapse of the structure.

7 Claims, 4 Drawing Sheets

PRESSURE-SENSITIVE ROOF STRUCTURE FOR SCREENED ENCLOSURES OF SWIMMING POOLS, SPAS OR PATIOS

RELATED APPLICATIONS

This application claims the benefit of U.S. Provisional Patent Application Ser. No. 62/322,473, filed 14 Apr. 2016.

BACKGROUND OF THE INVENTION

Screened pool and patio enclosures popular in the southern United States are not capable of withstanding structural loads imposed by snow and ice common in northern climates. Additionally, screened enclosures in all climates are vulnerable to damage caused by high winds.

Other systems require the user to remove, release or store the panels prior to winter or severe weather conditions. This is a cumbersome activity and typically requires use of a ladder or other elevated platform to access the means of attachment to the structure. Weather in northern climates can be wildly unpredictable with fall storms that occur before panels are stored/removed for winter or spring storms which occur after panels have been reinstalled for the summer. In addition the storage/removal of the roof panels undesirably allows debris, leaves, insects, birds and other animals' access to the enclosed space.

SUMMARY OF THE INVENTION

By securing the roof panels with a pressure release system the roof can remain intact year round. If a storm occurs either with or without warning the structure will automatically provide relief from loads or forces that would ordinarily cause damage or even collapse.

Pressure sensitive roof panels are designed to release from their normal position in plane with the roof structure when the load imposed by snow, ice or wind reaches a predetermined level protecting the entirety of the structure from damage or collapse.

The claimed invention differs from what currently exists. This system allows for the roof to remain intact year round except when external loads, such as wind, snow and ice loads, cause the release of the panels.

By securing the roof panels with a pressure release system the roof can remain intact year round. If a storm occurs either with or without warning the structure will automatically provide relief from loads or forces that would ordinarily cause damage or even collapse.

A plurality of framing members to create the skeleton of the screen room structure are disclosed, a plurality of framed panels are provided and configured to fit between the structure framing members; each panel preferably covered in fiberglass screen mesh or similar. An angle or similar framing piece is provided to act as a limiting stop for the panel in when in plane with the structure. A hinge or hinges connect the panel to the structure. In one embodiment, magnetic pads or strips secure the panel to the limiting angles. Magnetic pads can be mounted via a spring tension system to allow the magnet to effectively gimbal to improve even contact between the magnet and receiving surface. Optionally, weather stripping can be provide to seal the panel to keep out debris, insects & vermin.

Framework and panels are constructed in the materials and methods such as aluminum extrusions, screw or rivet fasteners and fiberglass screening. Panels are attached using hinges which are screwed or bolted connections. Magnets are attached either by use of exterior rated adhesives or mechanically anchored with screws, rivets, etc. Once assembled, swing the hinged panels into place to engage the magnetic bond.

Optionally, weather stripping is provided. A handle attached to the frame opposite the hinged side is used in engaging or disengaging the panel from the magnetic bond.

It would be possible to change orientation the limiting angles by attaching them to the panels in lieu of attaching them to the main structure.

To use this invention one only needs to engage the magnetic bond to secure the roof panels in place by the panels into position. The invention provides worry free use and ownership of the screened enclosure regardless of otherwise damaging weather conditions.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
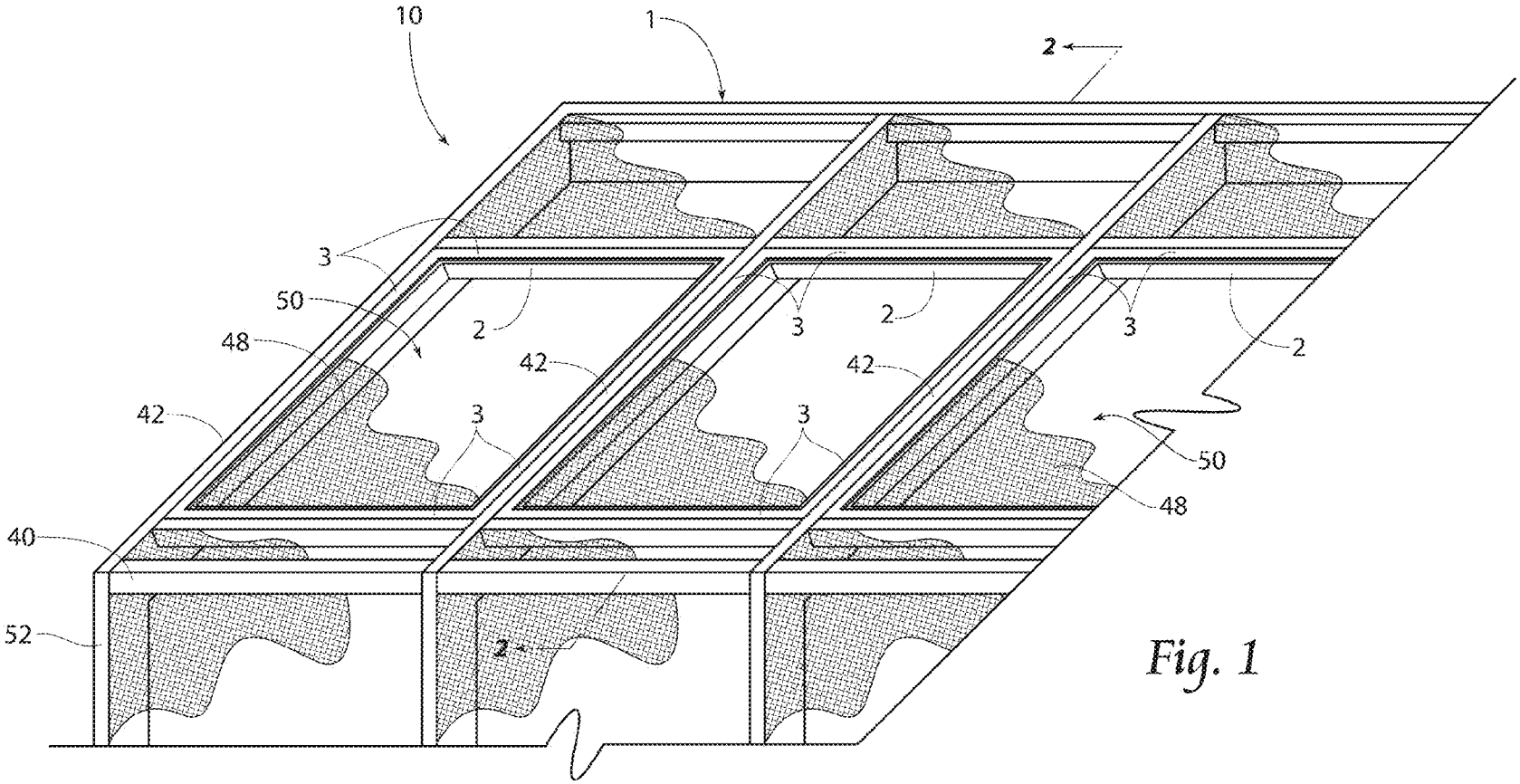
FIG. 1 is a top perspective view of the roof panels of the present invention.

Referring now to FIG. 1, a top perspective view of a roof panel system 10 of the present invention is shown. A roof panel system 10 cart be free-standing or coupled to a house for instance to be a three-season room or a swimming pool enclosure, as is known in the art. A truss structure 1 comprising horizontal members 40, rafters 42, ridge beams 44, second horizontal members 46 and vertical members 52 are installed to create a screen room structure skeleton. Panels 50, comprising a screen 48 and screen frame 2, are fabricated to closely fit between the rafters 42 but have adequate clearance not to contact the rafters 42. Angles 3 are attached to the second horizontal members 46 to limit the panel from extending past the plane of the truss structure 1.

Figure 2:
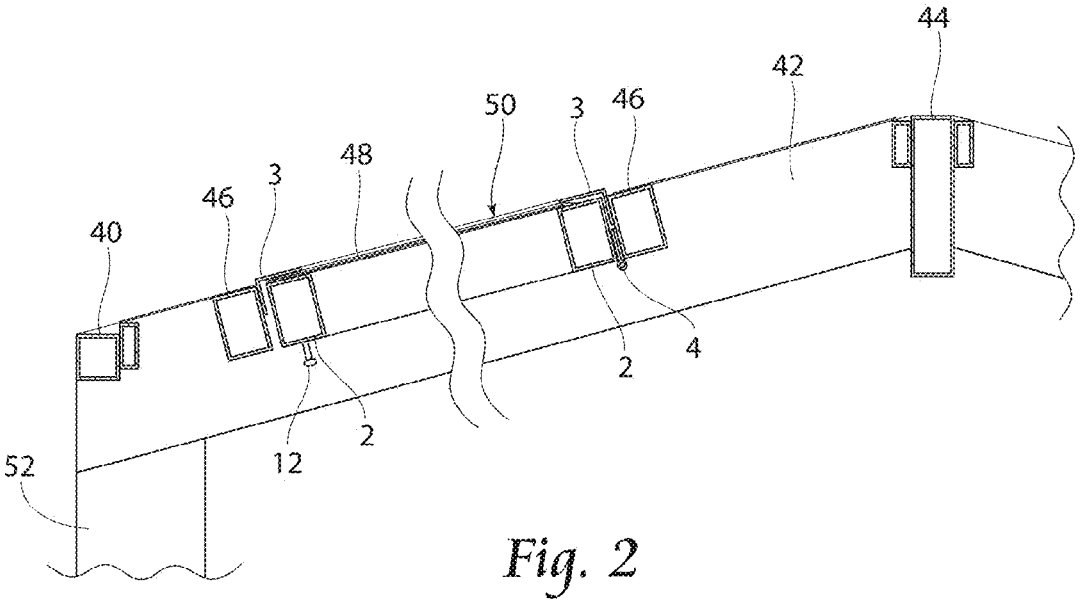
FIG. 2 is a side cross-sectional view of one embodiment of roof panels of the present invention carried by a truss structure.
Figure 3:
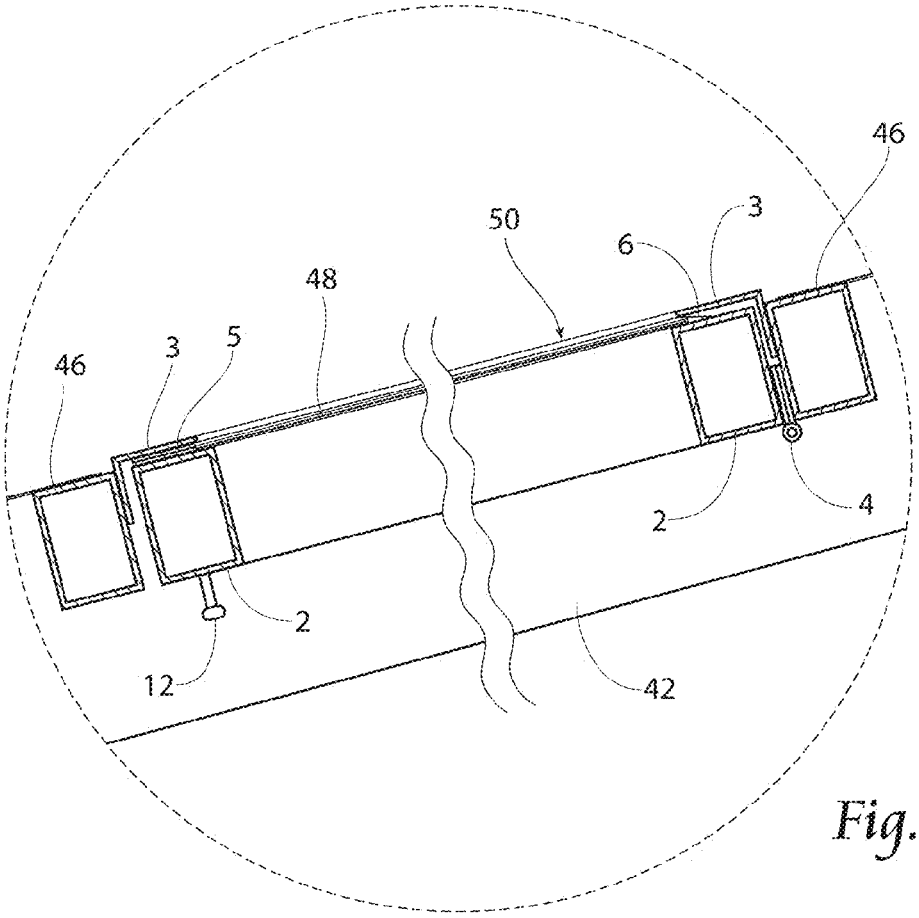
FIG. 3 is a close-up view of the embodiment of FIG. 2.

Referring now to FIGS. 2 and 3, a side cross-sectional view of one embodiment of roof panel system 10 of the present invention carried by a truss structure 1 is shown. Panels 50, comprising a screen 48 and screen frame 2, are attached to the truss structure 1 by hinge or hinges 4. Magnetic pads or strips 5 are attached to the face of the limiting angle 3 and to the matching face of the panels 50.

Magnetic pads or strips 5 can be eliminated on one face of the panels 50 or limiting angle 3 by substituting a ferrous surface opposite the magnet 5 for bond. Weather stripping 6 is attached to reduce infiltration of insects and debris in areas where there is not a seal between the magnet 5 and the limiting angle 3.

In a preferred embodiment, a latch or handle 12 can be provided coupled to a convenient location such as an underside of panels 50. Latch 12 can be used to manipulate panels 50 open or closed as desired.

Figure 4:
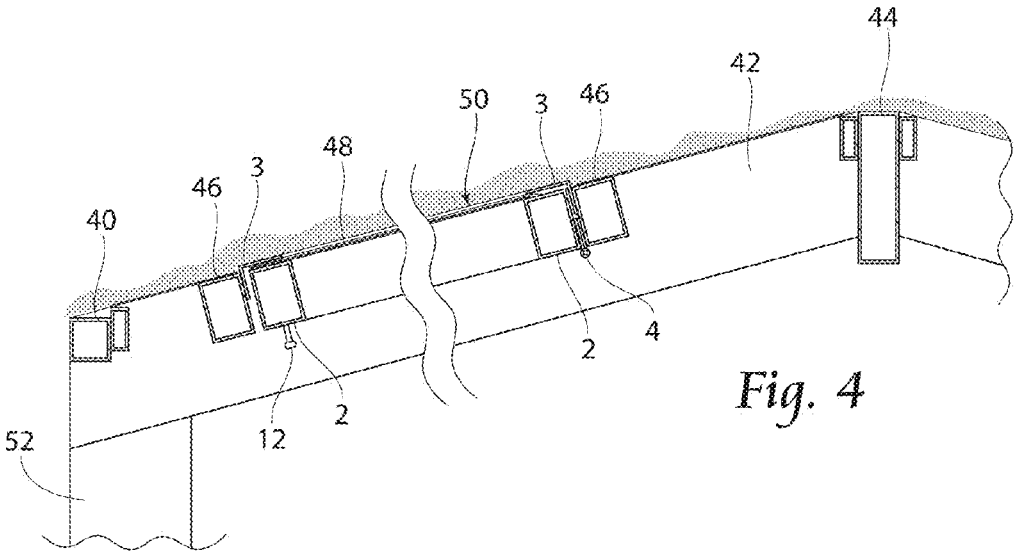
FIG. 4 shows the embodiment of FIG. 3 carrying a snow load.
Figure 5:
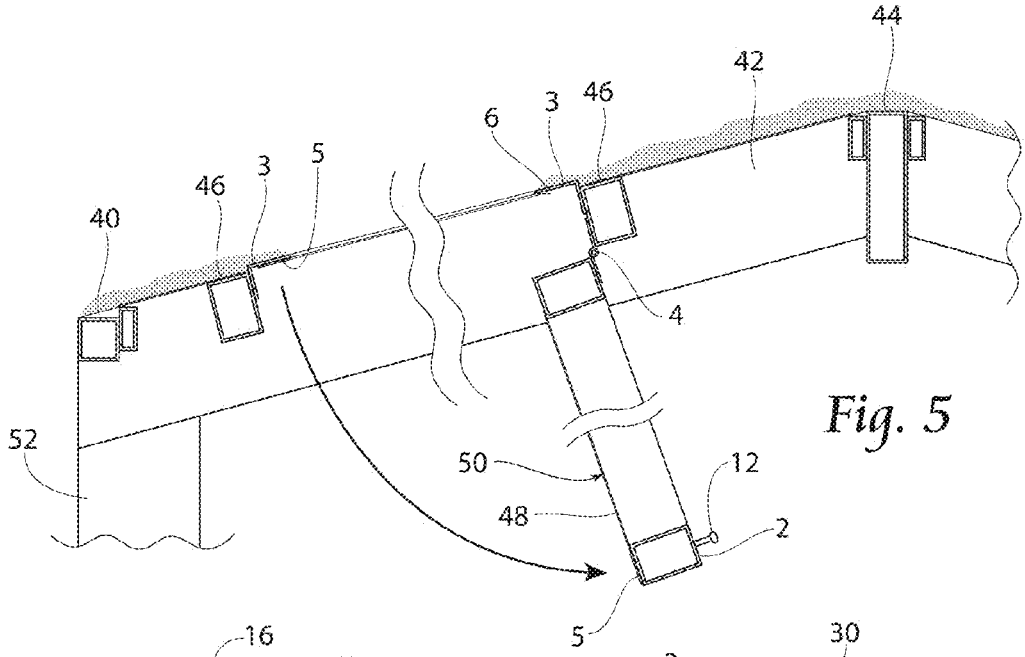
FIG. 5 is a side view of the embodiment of FIG. 4, the roof panel pivoting under the weight of the carried load.

In a preferred embodiment, panels 50 are sized to fit in length and width between the main rafters 42. The area of individual panels 50 are used to calculate the strength of magnetic bond required of magnets 5 for the applied load. The magnetic, bond is preferably designed to adequately restrain the panels 50 in the secured position during periods of normal weather conditions and allow the panels 50 to release from the secured position when applied loads due to weather conditions exceed design capacity (see, e.g., FIG. 4 and FIG. 5). For example, in a preferred embodiment, the panels 50 may be designed to have the panels 50 release once the applied load reaches 3 psf (pounds per square foot), but cart be in excess of 5 psf if desired. For exemplary purposes, at a 5 psf design capacity, if a panel measures 7'×8' (56 sq. ft.) the total design load is 280 lbs. with ½ of the weight supported by the hinges and ½ the weight supported by the magnets. The panel in this example would preferably require 140 lbs. of magnetic resistance force from the sum of magnets 5 for a particular panel 50 to meet the design parameters. If the applied load should exceed the design parameters, the panel 50 is allowed to pivot open (see, FIG. 5).

The panels 50 are attached by hinge(s) 4 to the truss structure 1 and are swung into position in plane with the truss structure 1 engaging the magnets 5 to retain the panels 50 in place. Panels 50 may remain in place year-round, only disengaging from their magnetic bond when loading exceeds designed release pressure.

Figure 6:
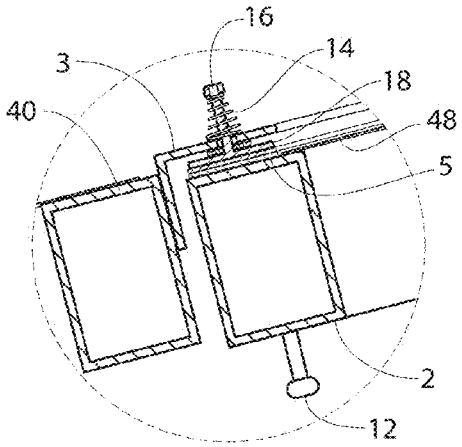
FIG. 6 is a close-up view of a gimbal mount structure for opening and closing the roof panel.

Referring now to FIG. 6 a close-up view of an alternate embodiment, a gimbal mount structure for opening and closing the panels 50. The magnetic catch system 5 can be augmented by mounting the magnet 5 to the panels 50 or limiting angle 3 utilizing a spring 14 to allow the magnet 5 to gimbal in making contact with the opposing magnet or ferrous surface 5 of panel 50. A. machine bolt or pin 16 carries a spring 14 (preferably conical) which allows magnet 5 to gimbal. In a preferred embodiment, a hole for the machine bolt 16 is oversized (which allows for conical spring 14) allowing the magnet 5 to pivot in any direction to maintain flat contact with the opposing (magnet or ferrous) surface of panel 50. Spring 14 is preferably attached to angle 3 with a ferrous plate 18 removably coupled with attached an upper surface of panel 50.

Figure 7:
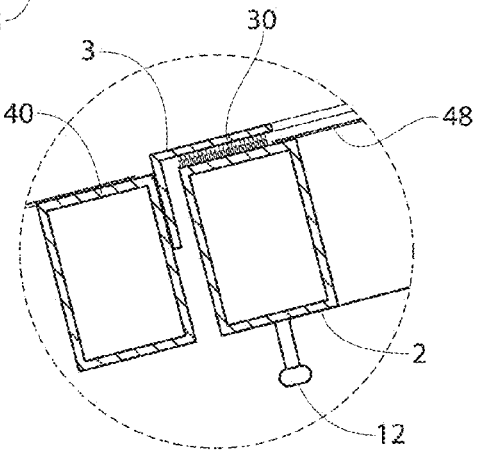
FIG. 7 is a close-up view of an alternate embodiment of a closure mechanism for the roof panel.

Referring now to FIG. 7 a close-up view of an alternate embodiment of a closure mechanism for the roof panel is shown. In this embodiment, a hook and loop type fastener 30 is used in place of or in addition to magnet 5.

Figure 8:
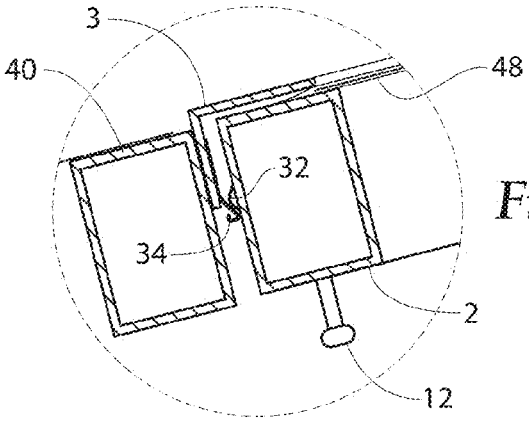
FIG. 8 is a close-up view of an alternate embodiment of a closure mechanism for the roof panel

Referring now to FIG. 8 a close-up view of an alternate embodiment of a closure mechanism for the panel 50 is shown. In this embodiment, a mechanical fastener comprising a spring 34 carried by angle 3, and catch 32 carried by panel 50 is supplied, with frictional forces maintaining the panel 50 in open or closed condition, again configured to sustain a predetermined load.

Figure 9:
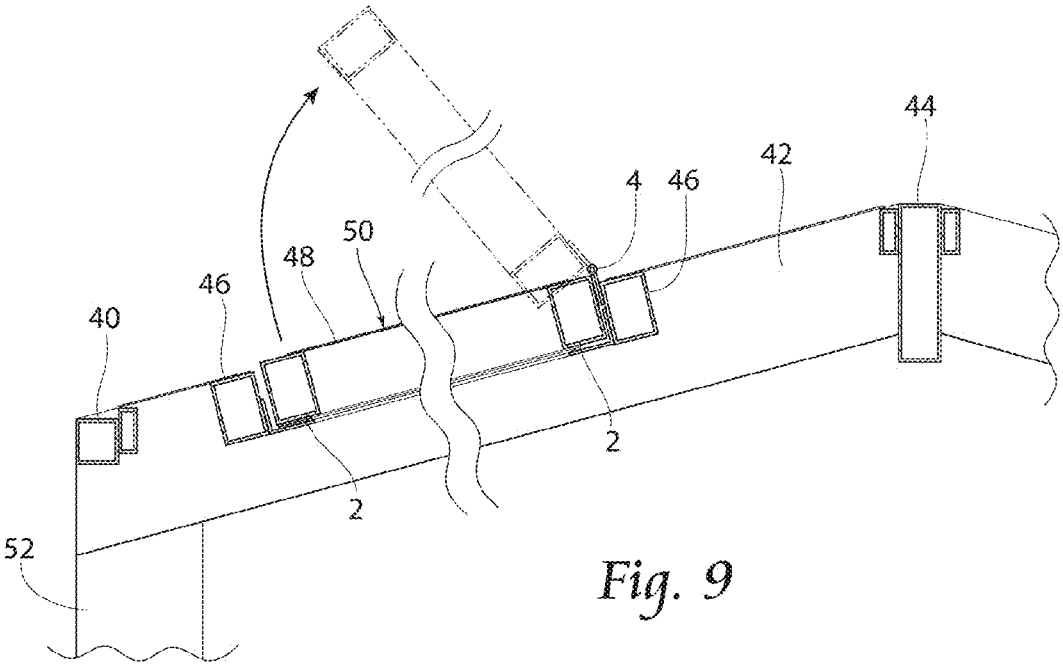
FIG. 9 is an alternate embodiment of the present invention showing a pressure release against a wind uplift force.

Referring now to FIG. 9, an alternate embodiment of the present invention is shown, with the system 10 designed to swing open upwardly, for instance to release against a wind uplift force. An uplift design for hurricane or tornado prone areas could be employed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A structure comprising:

a truss structure carrying a roof panel;

said roof panel pivotally coupled to said truss structure;

a load sensitive coupling mechanism to couple said roof panel and said truss structure, said load sensitive coupling mechanism responsively allowing said roof panel to pivot from a first, panel closed position, downwardly to a second, panel open position. in response to a predetermined load applied against an upper surface of said roof panel.

2. A structure according to claim 1, said structure further comprising a plurality of roof panels coupled across a length and a width of said truss system.

3. A structure according to claim 1, said load sensitive coupling mechanism comprising a magnet releasably coupling said roof panel and said truss structure.

4. A structure according to claim 3, said predetermined load comprising at least 3 pounds per square foot.

5. A structure according to claim 3, said predetermined load comprising at least 5 pounds per square foot.

6. A structure according to claim 1, said load sensitive coupling mechanism comprising a hook and loop system releasably coupling said roof panel and said truss structure.

7. A structure according to claim 1, said load sensitive coupling mechanism comprising a spring releasably coupling said roof panel and said truss structure.

* * * * *